US005119779A

United States Patent [19]

Plohberger et al.

[11] Patent Number: 5,119,779

[45] Date of Patent: Jun. 9, 1992

[54] METHOD AND DEVICE FOR FEEDING FUEL INTO THE COMBUSTION CHAMBER OF AN INTERNAL COMBUSTION ENGINE

[75] Inventors: Diethard Plohberger; Peter Herzog; Keith Elliott; Christof D. Fischer; Josef Greier, all of Graz, Austria

[73] Assignee: Avl Gesellschaft Für verbrennungskraftmaschinen und Messtechnik M.B.H. Prof.Dr.Dr.h.c. Hans List, Graz, Austria

[21] Appl. No.: 676,359

[22] Filed: May 13, 1991

Related U.S. Application Data

[62] Division of Ser. No. 350,560, Jun. 9, 1989, Pat. No. 5,020,494.

[30] Foreign Application Priority Data

Aug. 12, 1987 [AT] Austria ..... 2039/87
May 18, 1988 [AT] Austria ..... 1303/88

[51] Int. Cl.[5] ..... F02M 67/04
[52] U.S. Cl. ..... 123/250; 123/532
[58] Field of Search ..... 123/250, 251, 252, 531, 123/532, 316, 255, 292

[56] References Cited

U.S. PATENT DOCUMENTS

| | | | |
|---|---|---|---|
| 1,609,258 | 11/1926 | Lonaberger et al. | 123/250 |
| 1,837,557 | 12/1931 | Leonard | 123/250 |
| 1,892,040 | 12/1932 | de Malvin de Montazet et al. | 123/531 |
| 2,710,600 | 6/1955 | Nallinger | 123/532 |
| 4,210,105 | 7/1980 | Nohira et al. | 123/250 |
| 4,865,002 | 9/1989 | Borst et al. | 123/532 |

*Primary Examiner*—Andrew M. Dolinar
*Attorney, Agent, or Firm*—Watson, Cole, Grindle & Watson

[57] ABSTRACT

In a method and device for feeding fuel into a combustion chamber of a cylinder of an internal combustion engine the following steps are discerned to withdraw a small amount of compressed hot gas via a valve opening into the combustion chamber of the cylinder during one working cycle, to store this small amount of hot gas withdrawn, in a valve chamber of the valve, to inject fuel into this valve chamber containing the small amount of hot gas, building a fuel-gas mixture, and to inject the fuel-gas mixture through the valve opening into the combustion chamber of the cylinder during next working cycle of the internal combustion engine.

14 Claims, 8 Drawing Sheets

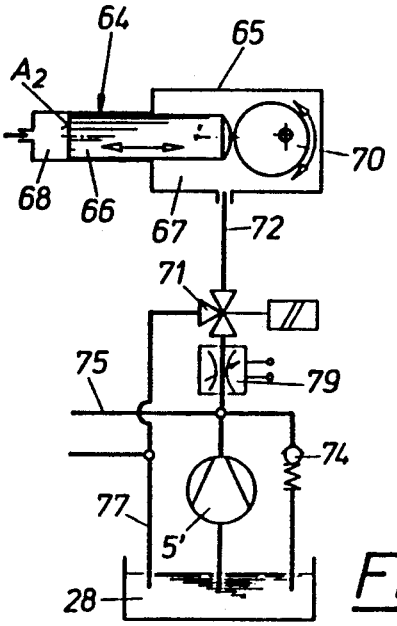
Fig. 6
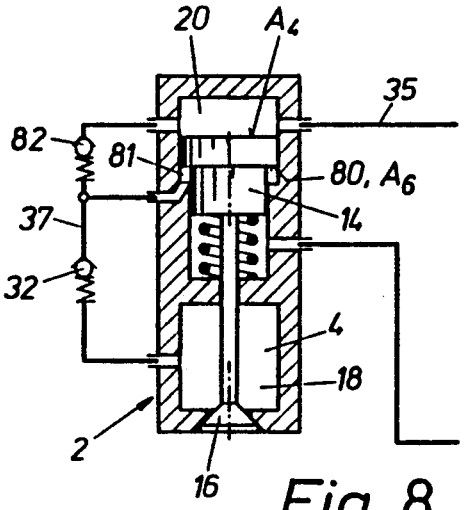
Fig. 8
Fig. 10
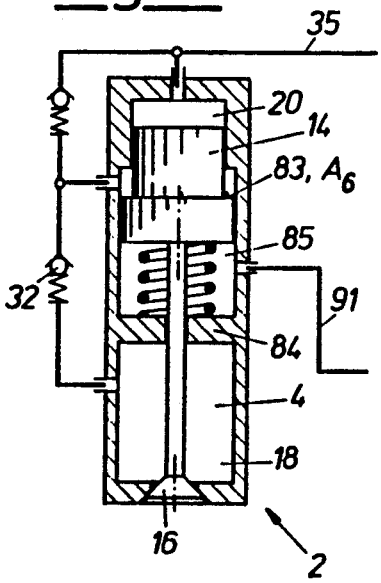
Fig. 13
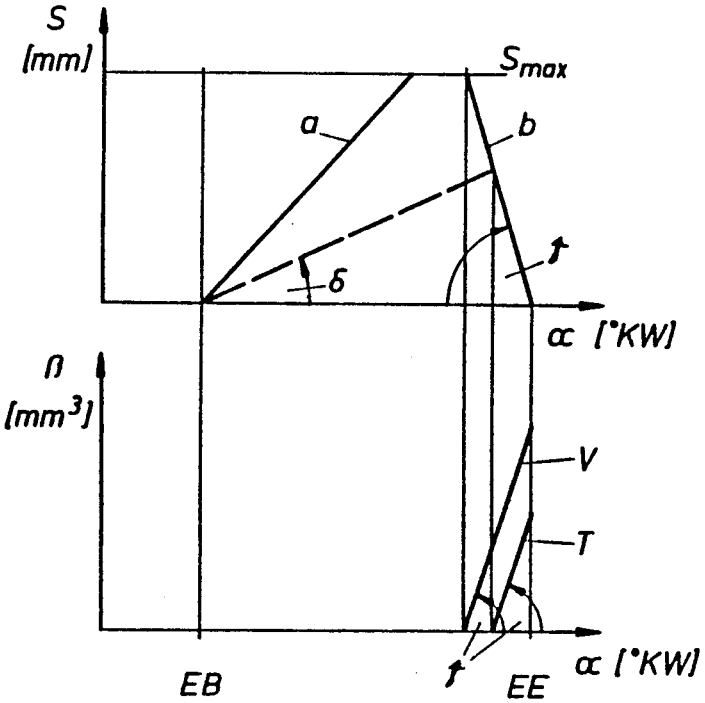

METHOD AND DEVICE FOR FEEDING FUEL INTO THE COMBUSTION CHAMBER OF AN INTERNAL COMBUSTION ENGINE

This application is a divisional application of application Ser. No. 350,560, filed Jun. 9, 1989, now U.S. Pat. No. 5,020,494.

BACKGROUND OF THE INVENTION

The invention relates to a method of feeding fuel into the combustion chamber of an internal combustion engine, in which compressed gas is taken from the cylinder and temporarily stored during one working cycle, and injected into the cylinder together with the fuel during the subsequent working cycle, and a device for implementing this method.

DESCRIPTION OF THE PRIOR ART

In order to obtain maximum thermal efficiency and minimum pollutant emission in internal combustion engines, above all in spark-ignition engines, rapid and thorough fuel combustion at the upper dead center of the piston is called for. If fuel is injected into the combustion chamber, or a fuel-air mixture is drawn in after having been mixed externally, these requirements cannot be met satisfactorily, since combustion is impaired by the lack of time available for mixture-formation. For this reason ignition must be timed such that it takes place well before the upper dead center.

Certain advantages are achieved by an external mixture-formation at elevated temperatures during the working cycle preceding ignition of the respective air-fuel mixture, and by injecting the mixture into the combustion chamber during the subsequent working cycle.

An arrangement for implementing the above method is described in DE-AS 1 751 524, in which the fuel is admitted through a joint rotary valve provided for all cylinders of an internal combustion engine. The rotary valve, comprising a disk-shaped rotor, a thin, disk-shaped distributor plate and a mushroom-shaped control slide, is located in a housing together with a centrifugal pump sitting on a joint shaft together with the rotor. In four-stroke engines shaft and pumpe and rotor have the same r.p.m. as the camshaft. The rotor itself contains a radially positioned metering chamber whose control surface facing the distributor plate has several control openings. In addition, the rotor is provided with an axial storage opening controlling the storage of pressurized air, which is admitted from the cylinder chambers through an injection line. In this manner pressurized air is taken from the respective cylinder chamber during the compression stroke, and is used as a source of pressurized air for blowing fuel into the respective cylinder chamber.

The disadvantages of this arrangment are its complicated configuration as well as the use of one common metering and control unit for all cylinders of a multicylinder engine. This necessitates long injection and discharge lines, which tend to clog during the withdrawal phase and in which fuel from the fuel-air mixture may be deposited on the walls during the injection phase, leading to faulty fuel metering that is difficult to control. In addition, the injection line, which is open towards the cylinder, causes a flowback of exhaust gas into the injection line during the expansion phase of the engine, and a flow of fuel-enriched gas into the cylinder during the charge-exchange phase, thus leading to higher hydrocarbon emission.

The sequencing of fuel injection and withdrawal is given by the shaft of the control and metering device rotating at camshaft or crankshaft speed. Thus it is not possible to adjust the beginning of injection to the requirements of the engine, in order to reduce fuel consumption and pollutants.

The fuel metering system of the conventional arrangement utilizes a metering chamber which is, alternatingly or consecutively, subjected to fuel pressure (in this instance lower than the air pressure in the injection or discharge line) and air pressure. In order to push the fuel into the metering chamber against the force of the higher air pressure prevailing therein, the metering chamber must be depressurized through a line into the suction pipe. The depressurization process represents a thermodynamic loss, since air which has been taken in by the engine is compressed, extracted and passed back into the suction pipe.

SUMMARY OF THE INVENTION

It is an object of this invention to propose a method of entering fuel into the combustion chamber of an internal combustion engine, and a device for implementation of this method, with which the above disadvantages can be avoided and the efficiency of the engine can be improved, in addition to permitting pollutant reduction and a simpler and more efficient control system.

In the invention this object is achieved by the steps below;

(a) timed withdrawal of a small amount, such as 2 to 6 ccm, of compressed hot gas via a valve opening into the combustion chamber of the cylinder;

(b) storage of the hot gas withdrawn, in a valve chamber of the valve;

(c) injection of fuel into the hot gas;

(d) injection of the stored fuel-gas mixture through the valve opening into the cylinder.

In further development of the invention it is proposed that an injection valve be provided as a withdrawal and injection unit, comprising a chamber immediately adjacent to the valve (=front chamber) and another one on the side facing away from the valve (=back chamber), whose valve element opening into the combustion chamber of the internal combustion engine is used for regulating the gas exchange between combustion chamber and front chamber, the latter serving as a storage cell for gases to be taken from the combustion chamber, and that the valve be actuated by an actuating element forming part of the wall of the back chamber, and that the front chamber of the valve be connected to the back chamber by one or more check valves, a pressure-generating unit delivering fuel into this back chamber. In this way a most simple variant is provided, in which the injection valve is simultaneously used as a gas-withdrawing valve, and the front chamber is used as a gas storage cell. The fuel is directly injected into the gas storage cell of the injection valve. Hydraulic actuation of the injection valve offers advantages such as higher actuating forces, variable opening velocities, larger valve strokes, over direct actuation by means of solenoid, rocker lever or cam.

Through the valve opening directly into the cylinder the gas to be withdrawn directly enters the storage cell, which is heat-insulated preferably, without having to pass through long, cold pipes, the elevated temperature in the gas storage cell protecting against the formation of carbon deposits.

The method and device described by the invention are designed predominantly for retared injection during the last forth or sixth of the engine cycle preceding the beginning of ignition.

In a variant of the method according to the invention the fuel-gas mixture formed during the preceding cycle is injected by a fuel pump before fuel-injection into the hot storage gas takes place at a higher fuel pressure. In further development of the device according to the invention the proposal is put forward that a reciprocating pump be provided, which is connected to the back chamber of the valve by means of a pressure line, whose pump chamber is connected with the fuel tank via a solenoid valve, another solenoid valve being located in an additional fuel line connecting the fuel tank and the pressure line. While the duration of injection and the injection quantity are coupled with regard to point in time and length of time by means of a single two-way valve, the use of a second solenoid valve, which is actuated independently of the first one, will permit de-coupling of the two functions, resulting in better adjustment of the engine with regard to fuel consumption and pollutant emission. The additional fuel line contains a check valve through which excess fuel is returned to the fuel tank.

Another method of de-coupling injection duration and injection quantity requiring only one solenoid valve and the corresponding power electronics, is proposed by the invention, according to which the solenoid valve is subjected to at least two different current intensities, e.g., by pulse-length-modulated OFF/ON switching of the voltage applied to the electromagnet of the solenoid valve, such that at least two different pressure levels are obtained. At the low current/force level an opening pressure is obtained which exceeds the closing pressure of the injection valve, causing the injection valve to open fully to its stop. This is followed by a pressure rise until the force of the solenoid valve is no longer sufficient to close the return line to the tank, thus causing the excess fuel delivered by the reciprocating pump to flow back to the tank. The solenoid valve is then subjected to a higher current intensity and closes again, against the fuel pressure in the line. Pressure will further rise to a level at which the check valve in the connecting line to the gas storage cell opens and fuel injection sets in. The injection process ends when the force at the solenoid valve is reduced to a low pressure level or to zero by suitable adjustment of the current; in the instance of zero pressure the injection of the fuel-air mixture also ceases.

Another variant of the invention provides that a reciprocating pump or fixed displacement pump delivering a constant amount of fuel be used together with a hydraulic metering device, and that the metering device have a metering plunger guided in a housing, which plunger travels between a chamber located in the housing on the actuating side and a metering chamber, its stroke being defined by two stops and determining the amount of fuel to be injected, and that the metering chamber be connected via a pressure line to the back chamber of the injection valve, and the chamber on the actuating side of the metering plunger be connected via a solenoid valve to the outlet end of the reciprocating pump or fixed displacement pump, and that a line be provided for filling the metering chamber, which should start at the pump and open into the pressure line, and which should be furnished with a check valve. The amount of fuel injected per engine cycle is determined by the stroke of the metering plunger travelling between two stops. This will permit accurate metering of the fuel.

In a further development of this variant, using a fixed displacement pump, e.g., a roller vane pump or a gear pump, the part of the metering plunger moving in the chamber on the actuating side of the metering device has a larger area $A_1$ subject to pressure than the part with area $A_2$ closing off the metering chamber, such that hydraulic amplification of the injection pressure is obtained at a ratio of $A_1/A_2$. The hydraulic amplification which can be obtained with the use of a metering device is achieved by means of a lesser-diameter-plunger with the area $A_2$ on the high-pressure side and a larger-diameter-plunger with the area $A_1$ on the low-pressure side.

The invention further provides that the chamber on the actuating side be closed by a diaphragm actuating the metering plunger, which diaphragm is subject to system pressure. The delivery stroke of the metering plunger is effected by the opening of the solenoid valve in the feed line.

According to the invention the chamber on the actuating side may be divided by a diaphragm actuating the metering plunger into an annular chamber receiving the feed line from the solenoid valve and into a spring chamber receiving the injection spring.

In the invention the injection quantity may be adjusted in accordance with the engine parameters by configuring one of the stops limiting the stroke of the metering plunger as an adjustable element, e.g., an eccentric actuated by a servomotor.

It is provided in a further development of the invention that a flow control unit be placed in the feed line leading into the chamber on the actuating side of the metering device, which unit should be actuated electrically and which should be used for controlling the stroke velocity of the valve element in the injection valve. By means of a flow-control unit the flow-rate may be adjusted continuously. Under conditions of partial load, i.e., low lifting rates of the needle the amount of fuel required is injected at a later point in time than under conditions of full load, i.e., high lifting rates of the needle. The advantage of this is that at high loads part of the fuel is directly entered into the combustion chamber during the same cycle, thus increasing interior cooling, whereas under conditions of partial load the entire fuel is preevaporated in the storage cell, thus ensuring minimum emission. Controlling the momentum of the gas jet on entry into the combustion chamber will permit control of the charge stratification, which in turn will influence the emission behavior of the engine.

Another control possibility is provided by furnishing the plunger of the injection valve with a step in order to obtain a variable valve lift, which step will form an annular chamber together with the wall of the housing and may be subject to pressure in the closing direction of the valve, and by connecting the annular chamber with the back chamber of the valve on the one hand and with the front chamber of the valve on the other hand, each time via a check valve. In this variant the valve lift of the injection valve is variable in proportion to the amount of fuel injected (simultaneous control). As compared to the variants without variable valve lift, this version has its advantages with regard to operating the engine under conditions of low load or full load.

It may further be provided that the plunger of the injection valve have a step in order to obtain a variable valve lift, which step will form an annular chamber together with the wall of the housing and may be subject to pressure in the opening direction of the valve, and that the annular chamber be connected to the pressure line on the one hand and to the front chamber of the valve on the other hand, each time via a check valve. In this variant injection into the storage cell takes place at the end of the charging phase of the storage cell, while the valve element in the injection valve is closing. During this period there is a flow of gas from the combustion chamber to the storage cell, and the fuel injected will remain in the storage cell until the next cycle.

In order to protect the valve spring in the injection valve, a further development of the invention may provide that a pressure or tension spring of the injection valve be placed in a spring chamber separated from the front chamber by a partition wall, the latter having an opening for the valve stem.

It is also possible within the scope of the invention that the valve is closed exculsively by the gas pressure acting upon the valve cross-section in the combusiton chamber of the internal combustion engine. In this instance no spring or spring chamber is required.

In order to simplify the device of the invention the proposal is put forward that a metering device with a metering chamber be located in the housing of the injection valve, whose metering plunger be coaxial with and in contact with the plunger of the injection valve, and that the back chamber of the injection valve also serve as the chamber on the actuating side of the metering device, and that the metering chamber be connected, via a reducing a valve, with the back chamber of valve on the one hand, and, via a check valve, with the front chamber on the other hand, and, further, that the back chamber be connected with the fuel feedline from the pressure-generating unit. In this variant injection valve and metering device are configured as a unit whose plunger are in contact with each other.

In the invention the pressure-generating unit may comprise a fixed displacement pump followed by an electronically actuated flow-control unit, and a pressure-relief valve located on the outlet end of the pump, a three-way solenoid valve provided, which connects the back chamber of the injection valve to the flow-control unit in one position, and to a return line into the fuel tank in another position. In this variant the valve will reach its stop only at full load approximately, whereas it will travel only part of its way under partial load conditions, depending on the rate of the valve lift. The valve lift is proportional to the quantity of fuel injected, and injection takes place during the closing movement of the valve.

In order to limit the maximum lifting rate or the maximum closing rate of the valve it is proposed that a fixed throttle be arranged both in the line between the flow-control unit and the three-way solenoid valve, and in the return line to the fuel tank.

In further development of the above variant the series-connected flow-control unit may be replaced by an electronically controlled pressure-control unit positioned parallel to the fixed displacement pump.

In a preferred variant of the invention the back chamber of the injection valve is closed off on the valve side by a diaphragm located normal to the valve axis, which is used for actuating the metering plunger as well as the injection valve. The chamber below the diaphragm being subjectable to pressure via a separate pressure line form the fixed displacement pump. This configuration is preferred to the one employing a closing spring in the injection valve, as it will automatically ensure a uniform closing force of all valves in a multicylinder engine, regardless of any tolerances of the spring forces. Besides, this is of importance for obtaining uniform injection quantities of all cylinders.

In order to protect a seal at the valve stem sealing against the gas pressure in the storage cell, it is porvided by the invention that the connecting line leading into the front chamber of the injection valve should open into an annular gap concentric with the valve stem, from which gap the fuel will flow into the gas storage cell in the direction of the valve.

In a particularly simple configuration of an injection valve the back chamber is connected with the front chamber by a through-going annular passage concentric with the valve stem, and a seal surrounding the valve stem is located in an enlarged portion of this passage, containing a pre-stressing element, e.g., an O-spring, as a check valve. This will seal the valve stem in bottom-to-top direction, i.e., from the front chamber to the back chamber of the injection valve, against a high pressure, and in top-to-bottom direction against a considerably lower pressure.

DESCRIPTION OF THE DRAWING

Following is a more detailed description of the invention as illustrated by the accompanying drawing, in which FIGS. 2, 4, 4*a*, 5, 6, 8, 10, 12, 14 are variants of FIG. 1.

DETAILED DESCRIPTION OF THE PREFERRED EMBODIMENTS

Figure 1:
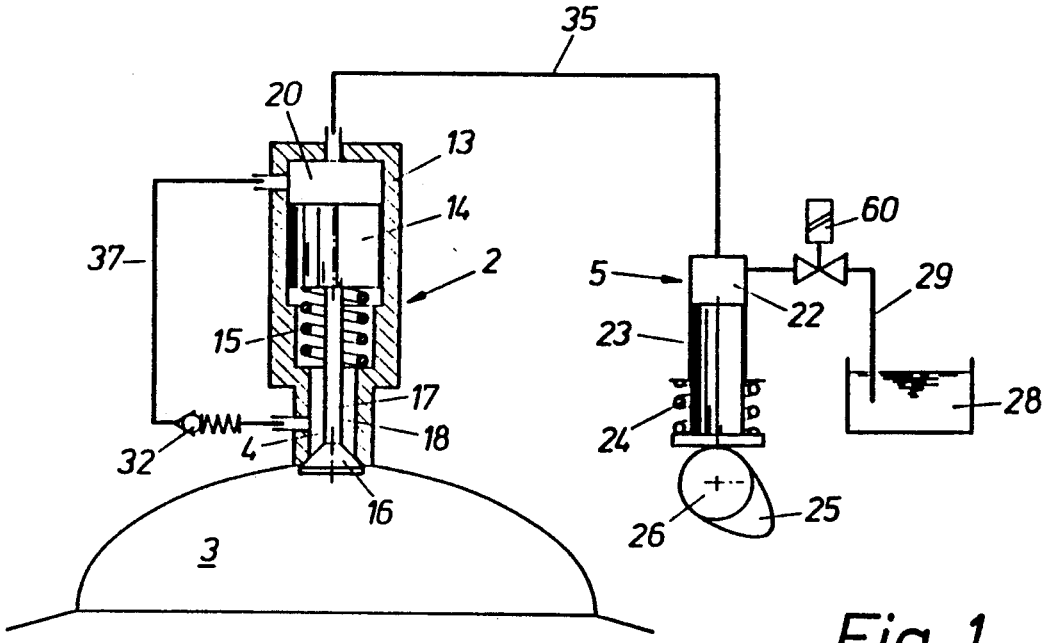
FIG. 1 shows a device according to the invention.

The variant of a system with reciprocating pump and constant lift of the needle presented in FIG. 1 shows an injection valve 2 connected with the combustion chamber 3 of an internal combustion engine not shown here, the front chamber 18 adjacent to the valve element 16 serving as a gas storage cell 4 at the same time. Preferably no withdrawal valve is used, and the fuel is directly injected into the storage cell 4 of the injection valve 2. The gas is withdrawn from the combustion chamber 3 through the injection valve 2 itself, by keeping it open for a suitable length of time after the end of the injection process. The injection valve 2 comprises a housing 13 in which the plunger 14 loaded by the spring 15 in closing direction slides axially. No spring is required if the effective areas of the plunger and the valve are dimensioned such that the gas pressure prevailing in the storage cell will close the valve automatically. The valve element 16 opening towards the combustion chamber 3 is connected to the plunger 14 via its stem 17. The back chamber 20 above the plunger 14 is connected to the gas storage cell 4 by means of a connecting line 37 containing a check valve 32. The connecting line 37 may also open into the pressure line 35, however, and thus be connected to the chamber 20.

The pressure-generating unit connected with the chamber 20 of the injection valve 2 via the pressure line 35, i.e., a reciprocating pump 5, has plunger 23 sliding in the pump cylinder 22, which plunger 23 is pressed by a spring 24 against its actuating cam 25. The cam 25, or rather, its camshaft 26, is driven by the internal combustion engine in a known manner. The fuel drawn from the fuel tank 28 via the line 29 will enter the pump cylinder 22 through a solenoid valve 60. It is also possible to provide a control unit for adjusting the fuel amount, for instance by means of an auxiliary plunger in the pump cylinder 22 with an adjustable stop limiting the stroke (not shown here).

Figure 2:
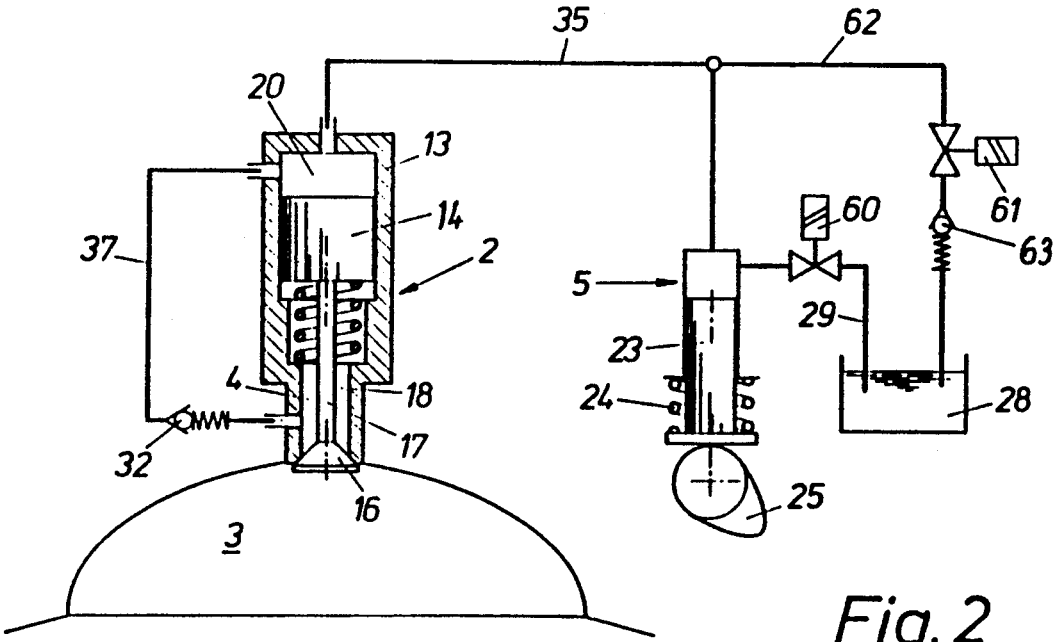

FIG. 2 is a variant of FIG. 1, in which the duration of injection and the quantity of fuel injected are coupled with regard to point in time and length of time by a joint control of the duration of injection (=length of opening period of the injection valve) and the injected quantity by means of a single two-way solenoid valve 60. With the arrangement in FIG. 2, using a second solenoid valve 61, which is actuated independently of the first one and is positioned in an additional line 62 connecting the fuel tank 28 with the pressure line 35, the two functions may be de-coupled, permitting better adjustment of the engine with regard to fuel consumption and pollutant emission.

Let the opening pressure of the injection valve 2 be $p_1$, and that of the check valve 63 in line 62 $p_2$, and that of the check valve 32 $p_3$. At the beginning of injection the solenoid valve 60 will close while the valve 61 will remain open. As soon as the pressure $p_1$ is reached at the injection valve 2, the latter will open until the plunger 14 has reached its stop. This will initiate a further pressure rise up to the level of $p_2$, opening the check valve 63 and causing the excess fuel to return into the tank. The beginning of injection into the gas storage cell 4 is initiated by the closing of the solenoid valve 61, thus causing the pressure in the injection line to rise to $p_3$ and open the check valve 32. Fuel injection as such is either terminated by the opening of valve 61, or together with the injection of the fuel-air mixture by the opening of valve 60. Fuel metering is determined by the closing period of the solenoid valve 61 and the cam lift of the injection pump 5 taking place during this period.

Figure 3:
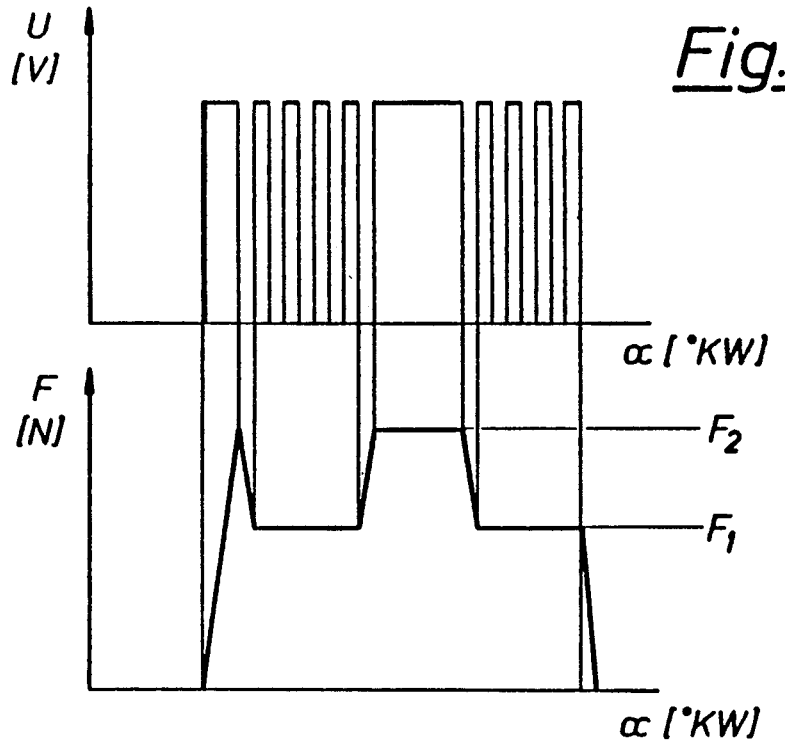
FIG. 3 presents a diagram of the voltage (U) and force (F) curves plotted against the crank angle $\alpha$ for a solenoid valve as in FIG. 1, FIGS. 4*b*, 7, 9, 11, 13, show diagrams representing the needle lift S and the injection quantity $\beta$ plotted over the crank angle $\alpha$, FIG. 15 gives a detailed view of an injection valve according to the invention.

The diagram in FIG. 3 presents a variable voltage curve U and the resulting force curve F for a solenoid valve, in which the benefits of the variants shown in FIGS. 1 and 2 may be combined. Due to the particular actuation of the solenoid valve 60 in FIG. 1 the use of a single solenoid valve and corresponding power electronics will suffice in order to de-couple the duration of fuel-air injection and that of fuel injection, and thus fuel metering. With reference to FIG. 1 the solenoid valve 60 is subjected to two different current intensities. This may be effected by different methods, for instance by pulse-length-modulated OFF/ON switching of the voltage applied to the solenoid. In this way two different force levels $F_1$, $F_2$are obtained at the solenoid valve 60. At the lower current/force level $F_1$ an opening pressure exceeding the pressure $p_1$ is obtained, such that the injection valve 2 opens to its stop. Pressure will subsequently rise to a level $p_2$ at which the force of the solenoid valve is no longer sufficient to close the return line into the tank 28, thus permitting the fuel delivered by the reciprocating pump 5 to flow back to the tank. Subsequent to this the solenoid valve 60 is subjected to the higher current intensity such that is closes again, against the fuel pressure in the line. There is a further pressure rise to the level $p_3$ at which the check valve 32 opens and fuel injection sets in. Fuel injection ceases when the force at the solenoid valve 60 is reduced to $F_1$ or 0 by suitable adjustment of the current; in the instance of zero pressure injection of the fuel-air mixture also comes to an end.

Figure 4:
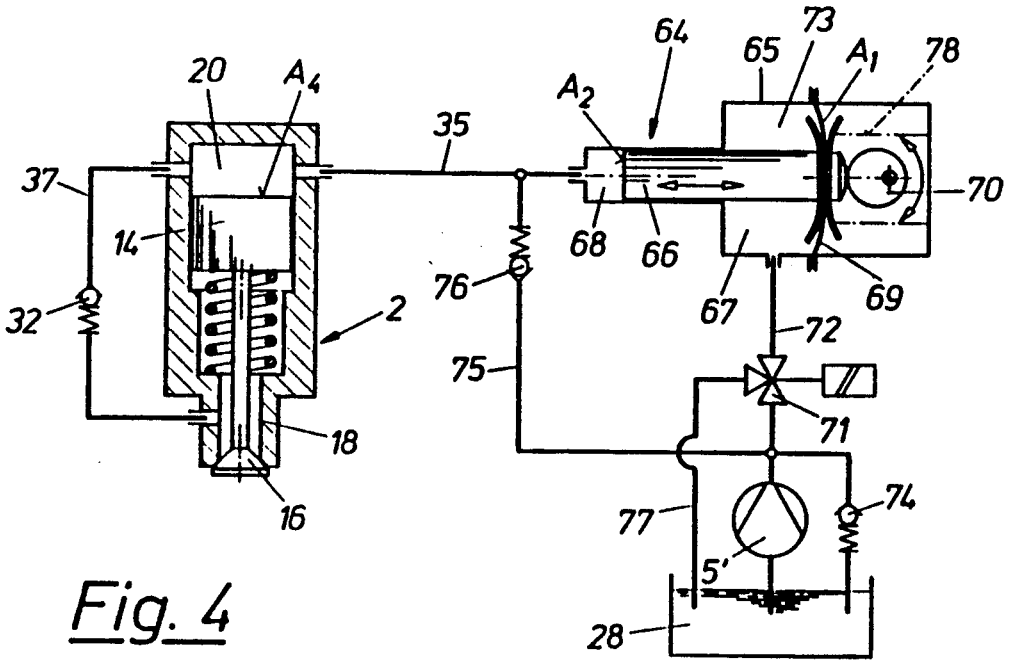

As a modification of the system shown in FIG. 1 a system with low-pressure actuation and constant needle lift is presented in FIG. 4. Instead of the high-pressure plunger pump 5 a fixed displacement pump 5' is used in conjunction with a hydraulic amplification and metering device 64, for example a conventional roller vane pump or a gear pump. The metering device 64 has metering plunger 66, which is guided in a housing 65 and divides the housing into a chamber 67 on the actuating side and a metering chamer 68. Hydraulic amplification results from a plunger of a smaller diameter with the area $A_2$ on the high-pressure side and a flexible diaphragm or plunger of a larger diameter with the area $A_1$ on the low-pressure side. The metering plunger 66 and the diaphragm 69 are combined in one unit. This unit moves between a fixed and an adjustable stop 70, the latter being positioned—as shown—either on the low-pressure side or on the high-pressure side. The distance between the two stops is proportional to the quantity of fuel to be injected. By means of hydraulic amplification the pressure generated by the fixed displacement pump 5', typically 2 to 8 bar, is intensified at a ratio $A_1/A_2/A_4$ to the level required for the fuel injection system, i.e., 10 to 40 bar approximately, $A_4$ representing the cross-section of the hydraulic plunger 14 actuating the injection valve 2. The amount of fuel injected per cycle is determined by the metering plunger 66 moving backward and forward once per cycle over a variable distance. The adjustable stop is configured as an excentric 70 or a cam which is turned by a servomotor with position feedback or by a step motor with electronic actuation.

The pressure amplification and metering device 64 as well as the injection process are controlled by means of a three-way solenoid valve 71, which is actuated by suitable control electronics. The solenoid valve 71 opens a line 72 towards an annular chamber 73 surrounding the metering plunger 66, which chamber is closed off by the diaphragm 69, the system pressure generated by the pump 5' via the pressure-keeping valve 74 moving the metering plunger 66 towards the adjustable stop 70 (suction stroke), against the spring force of the injection spring 78. At the same time the pressure line 35 and the metering chamber 68 are filled with fuel via a check valve 76 positioned in the line 75. Upon the subsequent closing of the solenoid valve 71 the annular chamber 73 closed off by the diaphragm 69 is relieved from pressure via a return line 77 into the tank 28, the injection spring 78 located in the housing 65 moving the metering plunger 66 in forward direction (delivery stroke). At the beginning of this movement the injection valve 2 is opened to its stop, via the quantity of fuel delivered, when its opening pressure is exceeded. There is a further rise in pressure, and the rest of the fuel to be delivered is injected into the gas storage cell 4 of the injection valve 2 when the opening pressure of the check valve 2 is exceeded. For a constant valve lift the quantity of fuel requird for opening the injection valve is constant for each cycle, and the adjustable stop limiting the stroke of the metering plunger 66 only serves for variation of the injection quantity (sequence control).

Figure 4A:
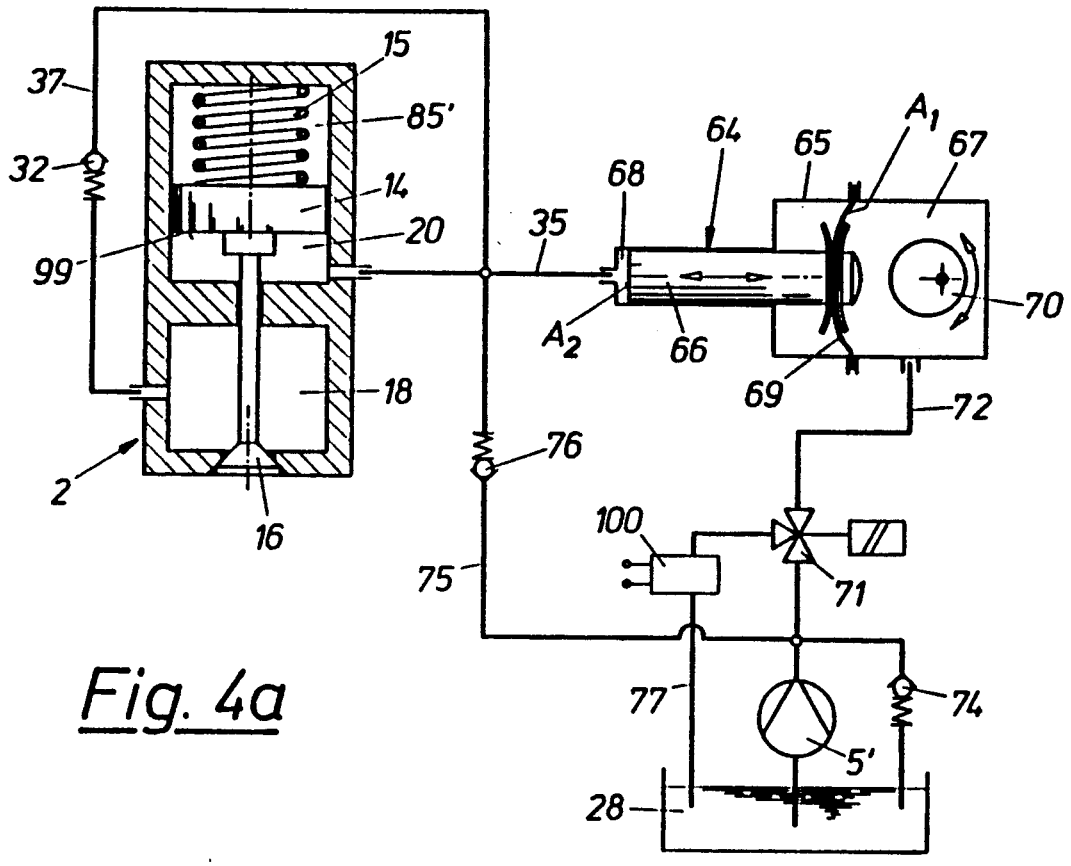

In a further variant presented in FIG. 4*a* the line 72 opens into the chamber 67 on the side of the diaphragm 69 facing the adjustable stop 70. In this instance the delivery stroke is effected by the opening of the valve 71, whereas the pressure relief via line 77 initiates the suction stroke. The spring 78 is not necessary here. The backward motion of the metering plunger 66 is ensured by subjecting the chamber 68 to system pressure.

The injection valve 2 closes due to the fuel pressure exerted on the annular surface 99 facing the valve element 16. the check valve 32 remains closed until the injection valve 2 rests against its valve seat. This is followed by a further pressure rise in the line 37 above the opening pressure $p_3$, which results in an opening of the check valve 32 and a flow of fuel into the gas storage cell 4. This process is completed once the metering plunger 66 has reached its stop on the high-pressure side. This position is the idle or initial position of the system.

At the beginning of the injection process the low-pressure chamber 67 is depressurized through the three-way solenoid valve 71. In the return line 77 into the tank 28 an electronically controlled flow-control unit 100 is provided for control of the opening velocity of the injection valve 2. The injection valve 2 is opened by means of the pressure spring 15 sitting in the spring chamber 85' facing away from the valve element 16, which spring 15 is also used for resetting the metering plunger 66, the quantity of fuel to be injected being forced into the high-pressure line by the pump 5' through the check valve 76. The metering device 64 has no spring in this variant.

Figure 4B:
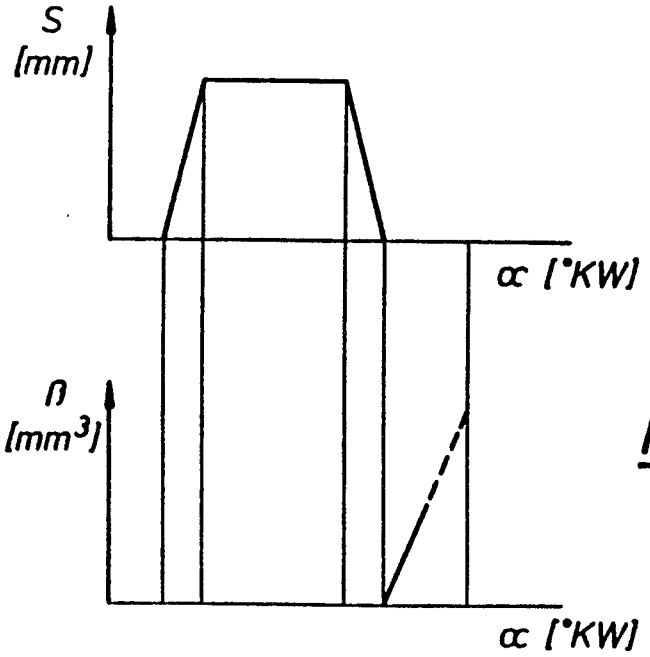

A diagram of the needle lift S and the quantity $\beta$ of fuel injected is presented in FIG. 4*b*. The advantage of this system over the one in FIG. 4 is that the fuel is injected only after injection of the fuel-air mixture has ended, and that the given relation of pressure and area ratios will permit a somewhat lower pressure level on the high-pressure side, and thus a reduction of the required power of the fuel pump.

Instead of the low-pressure supply unit with a fixed displacement pump a high-pressure unit with a reciprocating pump may be used which will eliminate the need for a pressure amplifier. Furthermore, an electronically controlled high-pressure plunger pump with non-constant delivery may be employed. In all instances the valve lifting rate is controlled by means of the flow control unit 100 located in the return line 77.

In all cases above the term "high-pressure" denotes pressures of more than 10 bar.

Figure 5:
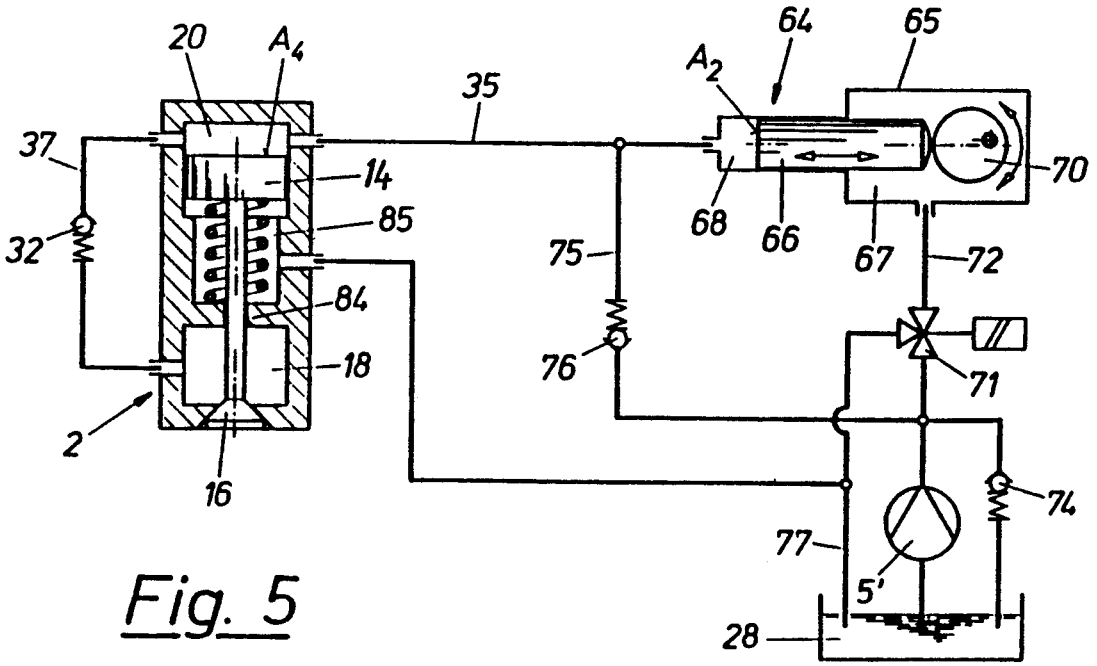

Another advantage is obtained by simplifying the system of FIG. 4. The diaphragm 69 or, possibly, a plunger with the area $A_1$ and the spring 78 driving the metering plunger may be eliminated, if the hydraulic amplification ratio required is guaranteed by a suitable cross-section $A_4$ of the plunger 14 in the injection valve 2, as is shown in FIG. 5. The metering plunger 66 with the area $A_2$ is only intended for metering purposes in this instance. The valve element 16 of the injection vale 2 will start lifting in this variant as soon as the three-way solenoid valve 71 opens the line from the fixed displacement pump 5' to the metering plunger. The valve element 16 will then move until the stop limiting its lift is reached in the valve body. The fuel injection phase following this process is terminated by a switchover of the three-way valve 71, as is the opening period of the injection valve 2, the chamber 67 opening towards the return line 77 to the tank 28 being depressurized. Further to this the pressure line 35 is filled through the check valve also serving as a pressure-reducing valve 76 in this case, and the metering plunger 66 is pushed back into its initial position. In this variant the pressure drop through the valve 76, or rather, the opening pressure of the valve 76, must be substantial enough to prevent the injection valve 2 from being opened by the filling pressure.

Figure 7:
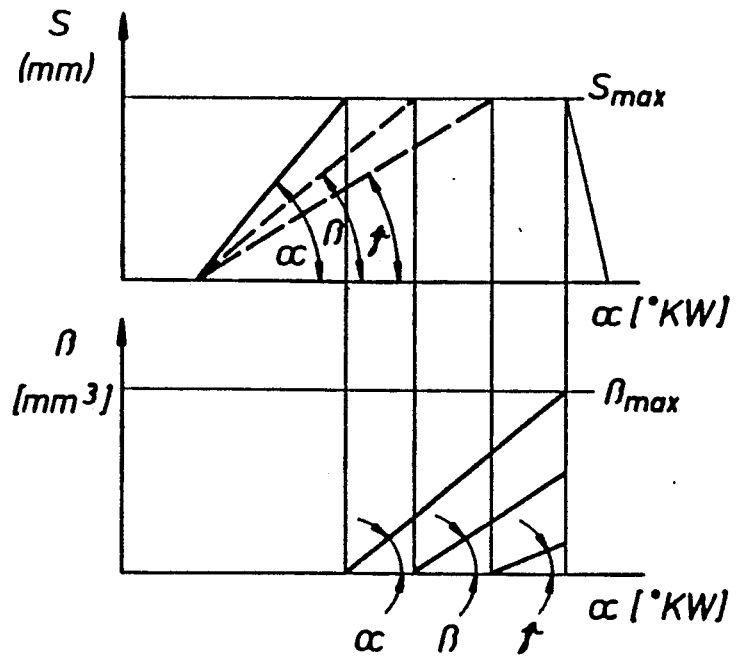

FIG. 6 presents a variant of the system shown in FIG. 5. With the use of a flow control unit 79 controlled by a unit not shown here, the lifting rate of the needle may be controlled, as is shown in FIG. 7 for the flow rates $\alpha$, $\beta$, $\gamma$. Under conditions of partial load, i.e., low lifting rates of the needle, the amount of fuel required is injected at a later point in time than under conditions of full load, i.e., high lifting rates of the needle. The advantage of this is that at high loads part of the fuel is directly entered into the combustion chamber during the same cycle, thus increasing interior cooling, whereas under conditions of partial load the entire fuel is pre-evaporated in the storage cell, thus ensuring minimum emission.

Besides, the variable rate of the needle lift will control the momentum of the gas jet upon entrance into the combustion chamber, and thus the stratification of the charge, which in turn will influence the emission behavior of the engine.

FIG. 8 presents a variant of the injection system shown in FIG. 5, in which the needle lift of the injection valve 2 is variable in proportion to the amount of fuel injected (simultaneous control). As compared to the variants without variable needle lift, this version is advantageous with regard to engine operation under conditions of partial load or full load; in this context the same statements apply as under FIGS. 6 and 7.

In the variant of FIG. 8 the plunger 14 of the injection valve 2 has a step 80 forming an annular chamber 81 together with the wall of the housing 13. The step may be subjected to pressure on its annular area $A_5$ in the closing direction of the valve, the annular chamber being connected with the back chamber 20 of the injection valve via a check valve 82, and with the front chamber 18 via a check valve 32.

The annular chamber 81, with its effective area $A_5$, is subjected to system pressure via the check valve 82. At the beginning of injection, i.e., when the metering plunger starts delivery, the plunger 14 of the injection valve 2 moves downwards and the valve element 16 opens. At the same time fuel is displaced from the annular chamber 81 and injected into the gas storage cell 4 through the check valve 32. The valve element 16 of the injection valve 2 will open only to an extent proportional to the injection quantity delivered by the metering plunger 66, the valve lift increasing with an increase of the engine load.

Figure 9:
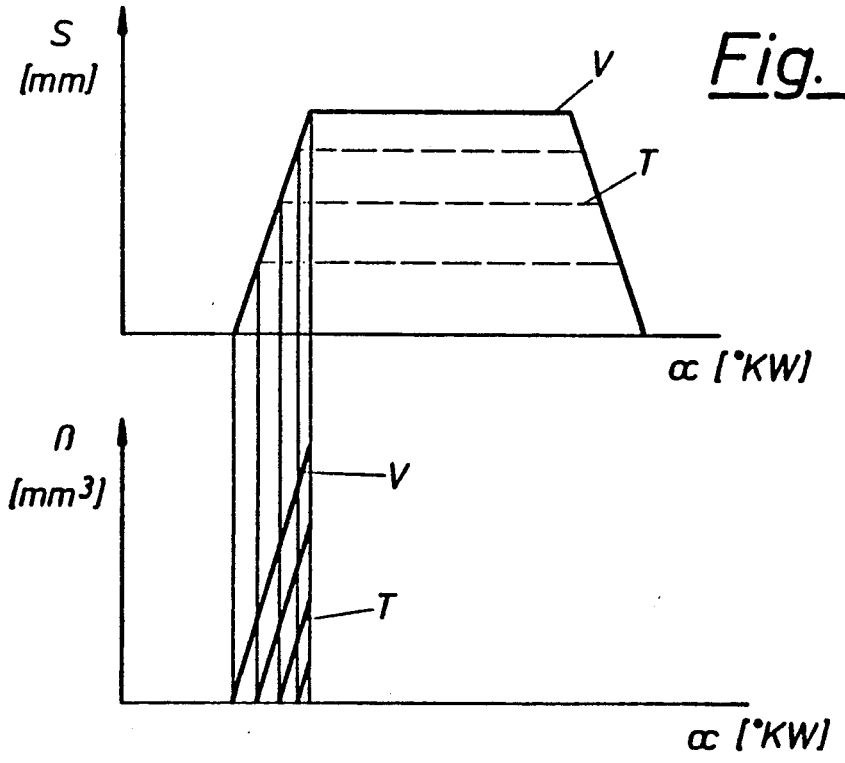

In the variant of the injection valve according to FIG. 8 the entire fuel quantity is injected into the gas storage cell 4 of the injection valve 2 during the opening phase of the valve at the beginning of the injection phase; this process is shown in the diagrams of FIG. 9. During this period there is a flow of gas from the gas storage cell 4 into the combustion chamber 3 of the engine, and a large portion of the fuel injected is directly conveyed into the combustion chamber together with the gas flow. (V . . . full load, T . . . partial load).

Figure 11:
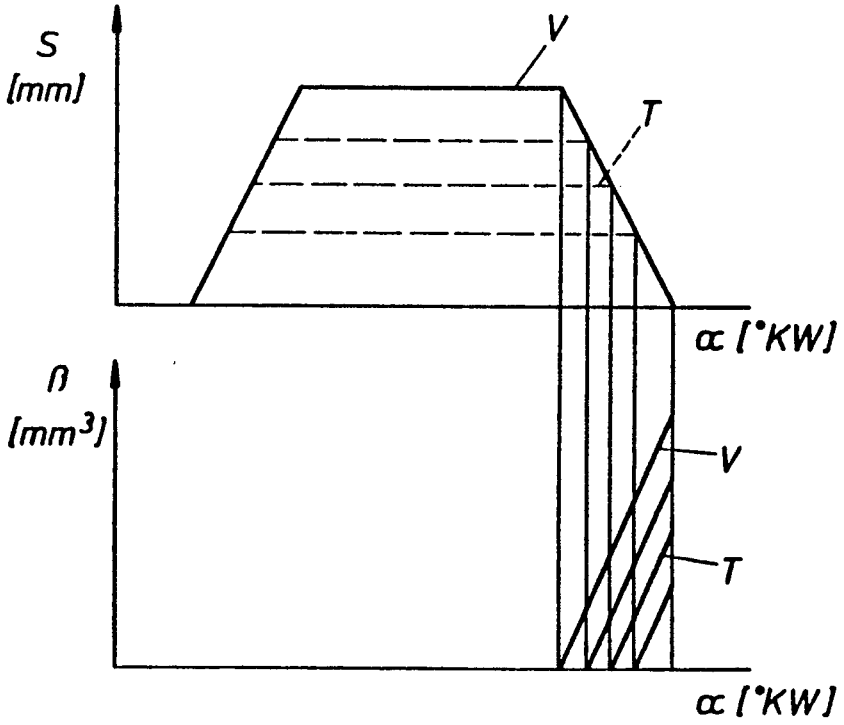

In the variant shown in FIG. 10, in which the plunger 14 has a step 83 that may be subjected to pressure in the opening direction of the valve element 16, injection into the gas storage cell 4 takes place at the end of the charging phase of the cell 4 during the closing phase of the valve. During this period there is a flow of gas from the combustion chamber 3 to the gas storage cell 4, and the injected fuel will remain in the storage cell until the next cycle, as is indicated in the diagram of FIG. 11.

The respective areas subject to the respective pressure in the low-pressure system are dimensioned such that the hydraulic amplification ratio, and thus the pressure rise in the injection line, is large enough, permitting all pressure forces, pressure drops due to check valves and frictional forces in the injection valve to be surmounted via the area $A_4$ of the plunter 14.

As shown in FIGS. 4, 5, 6, 8, 10, the variable-stroke metering plungers required per cylinder unit and the corresponding three-way solenoid valves may be combined in a control block independent of the injection valve 2, and pipe-connected with the respective injection valve. This is of advantage for the adjustment and synchronization of the metering plungers. It is also possible, however, to provide a metering device for each injection valve 2, the drive for adjustment of the stops of the metering plungers being located at the cylinder head of the engine. The former variant is preferred for engines comprising several cylinder banks, the latter for engines with one cylinder bank only.

The variable-stroke injection valves are configured such that they may also be used in conjunction with high-pressure plunger pumps, as presented in FIGS. 1 and 2.

In all variants the spring 15 of the injection valve 2 may be placed in a spring chamber 85 separated from the front chamber 18 by a partition wall 84, for the purpose of heat insulation. The spring chamber may have a relief line 91 (oil leakage pipe) into the low-pressure area.

Figure 12:
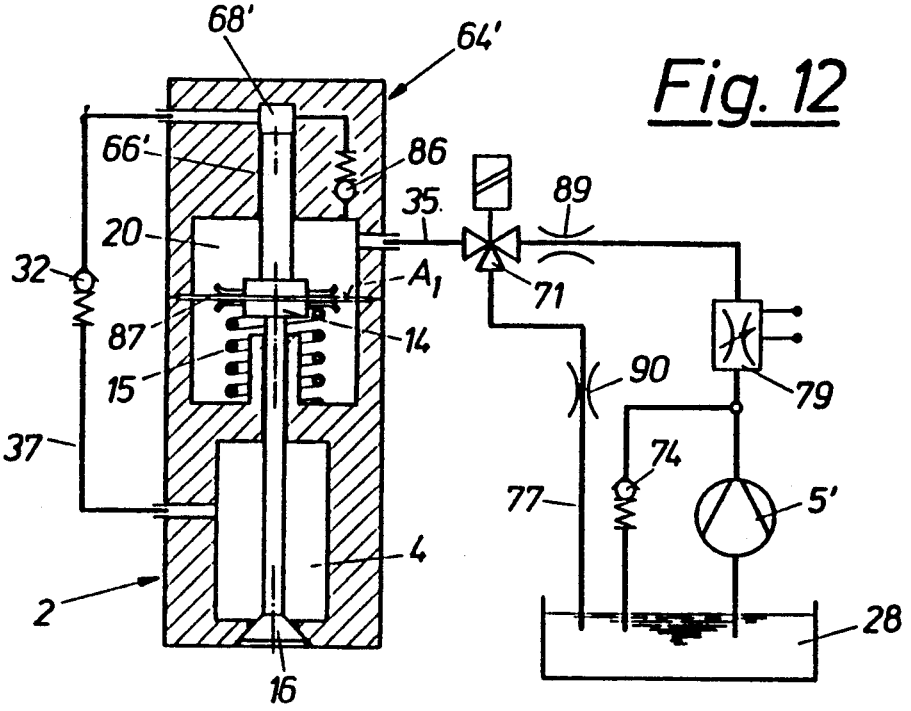

FIG. 12 shows another variant of a fuel-air-mixture injection system with variable needle lift. In this version a metering device 64' with a metering chamber 68' is positioned in the housing 13 of the injection valve 2, whose metering plunger 66' is coaxial with and in contact with the plunger 14 of the injection valve 2. The back chamber 20 of the injection valve 2 also serves as the chamber on the actuating side of the metering device 64', the metering chamber 68' being connected via a reducing valve 86 with the back chamber 20 on the one hand, and via the check valve 32 with the front chamber 18 on the other hand. In this variant the valve needle reaches its stop only under conditions of full load, whereas it will travel only part of its way under partial-load conditions, depending on the rate of the valve lift. The valve lift is proportional to the amount of fuel injected, and injection takes place during the closing movement of the valve needle.

Figure 14:
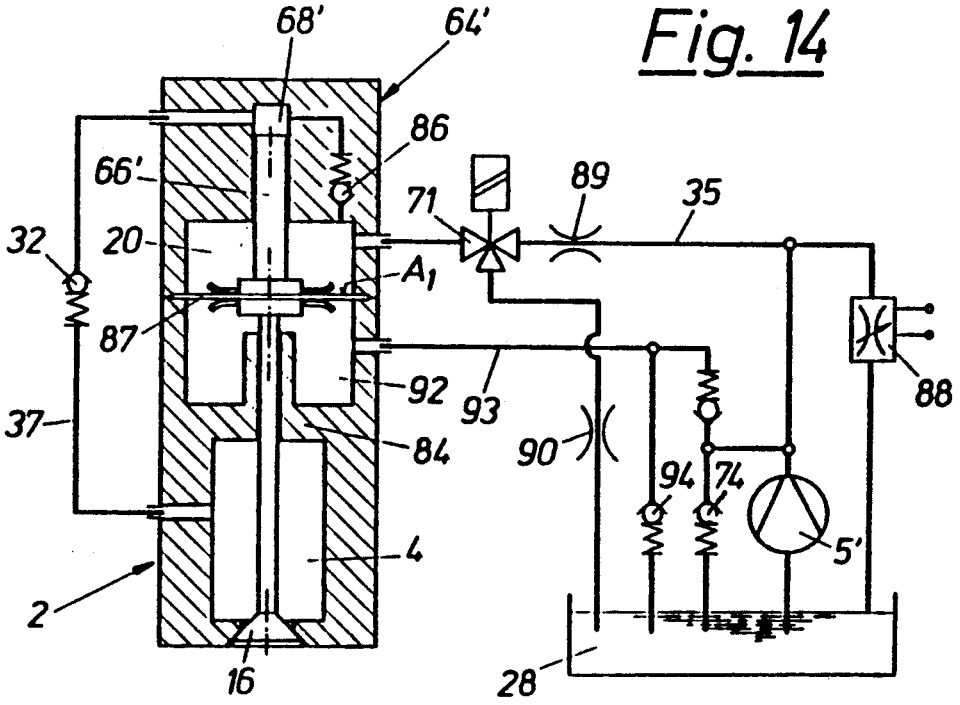

The pressure-generating unit comprises a fixed displacement pump 5' (6 bar approximately), a pressure relief valve 74 with the opening pressure $p_2$ and an electronically actuated flow control unit 79 in the main path. The flow control unit 79 may be configured as a throttle of variable cross-section, for example. The injection valve 2 comprises a valve element 16, which is driven via its stem 17 by a diaphragm 87 (as shown), or by a piston with the area $A_1$. A closing spring 15 keeps the valve element 16 closed. As soon as the three-way solenoid valve 71 is opened, subjecting the back chamber 20 to the system pressure $p_2$, the valve element 16 begins to open. The opening velocity of the valve element 16 is determined by the stream of fuel into the chamber 20, which in turn is regulated by the flow control unit 79 and by the force of the closing spring 15. Accordingly, the opening velocity of the valve is high in case of a high flow rate, and low for a low flow rate. Flow control may also be effected by means of a pressure control unit 88 in a by-path (cf. FIG. 14).

The fixed throttle 89 between the flow control unit 79 and the solenoid valve 71 will limit the maximum rate of the needle. When the injection valve 2 opens, the metering chamber 68' is filled with fuel via the reducing valve 86. The filling pressure is smaller than the opening pressure of the check valve 32 in the connecting line 37. The opening movement is terminated by the opening of the three-way valve 71, the chamber above the diaphragm, or rather back chamber 20, being depressurized through a return line 77 into the tank 28. A throttle 90 in the return line 77 limits the closing rate of the valve element 16.

Upon closing the metering plunger 66' displaces a fuel amount corresponding to the respective stroke, which is injected into the gas storage cell 4 via the check valve 32. Injection is effected by the force of the closing spring 15 and the gas pressure acting upon the cross-section of the valve stem. The mode of operation described above may be altered by modifying the metering plunger 66', such that injection takes place during the opening phase of the valve instead of its closing phase. The former version is used mainly in engines subject to severe emission regulations, as the temporary fuel storage in the storage cell 4 will reduce hydrocarbon emission in the exhaust. The latter version offers improved interior cooling in high-performance engines, as the evaporation heat of the fuel directly entering the cylinder is taken directly from the cylinder charge.

The maximum valve lift needed for the respective operational phase is determined by the lifting rate of the valve and its opening duration, which is controlled electronically via the solenoid valve 71. FIG. 13 gives a diagram of the valve lift S and the injection quantity $\beta$ plotted over the crank angle $\alpha$. Injection takes place during the closing stroke of the needle and ends as soon as the valve disk rests against the valve seat, regardless of the quantity injected. The beginning of injection, and thus the quantity to be injected, is determined by the slope $\delta$ of the opening line a and $\gamma$ of the closing line b, and by the opening duration of the valve from the beginning of injection EB to the end of injection EE. The injection rate is determined by the slope $\gamma$ of the closing line b given by the force of the closing spring, the gas force exerted on the cross-section of the valve stem and the cross-section of the throttle 90.

In a further variant (cf. FIG. 14, as mentioned above) the flow control unit is replaced by a pressure control unit 88 in a by-path. In conjunction with the throttle 90 and the counter-pressure in the chamber 92 below the diaphragm, the pressure control unit 88 determines the slope $\delta$ of the opening line a in FIG. 13. The pressure exerted on the chamber below the diaphragm replaces the closing spring 15 of FIG. 12. In a multicylinder engine this configuration automatically ensures a uniform closing force, and thus a uniform slope $\gamma$ of the closing line b, of all valves, regardless of any tolerances of spring forces. This is of importance for obtaining uniform injection quantities for the individual cylinders. The valve 94 controls the pressure in the chamber 92 below the diaphragm during the opening stroke of the valve element 16, thus determining the slope δ of the opening line a for all valves at the same time. With regard to all other details the device works as described under FIG. 12.

The general advantage of low-pressure technology is the lower cost of the overall system, since expensive components, such as the plunger pump and the high-pressure solenoid valves, are made superfluous. Metering via a plunger permits precise metering of the fuel amount to be injected, regardless of any tolerances in flow properties or switching times of the solenoid valves, which will also lower the manufacturing cost of the latter.

Figure 15:
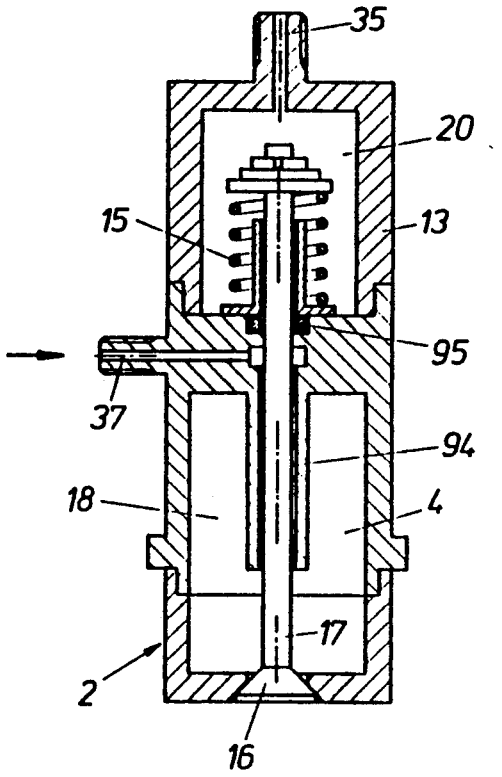

FIG. 15 gives a simplified view of an injection valve 2 as described above. It comprises a valve element 16 whose stem 17 slides in a two-part housing 13. The valve 16 is kept in closing position by its closing spring 15. The back chamber 20 is subjected to fuel pressure, causing the valve element 16 to open. The gas storage cell 4, or rather, the front chamber 18 is sealed against the upper pressure chamber 20 by means of an elastomer seal 95 (for instance, an O-ring). In order to protect this seal from the high gas temperatures, the fuel to be injected into the storage cell 4 is injected immediately below the seal 95 into an annular gap 94 of the valve guide, which is concentric with the valve stem 17. Through this annular gap 94 the fuel flows into the gas storage cell 4, where it evaporates. The gap is too narrow for the gas to reach the seal 95 against the flow direction of the fuel, which will protect the seal from soiling and overheating.

Figure 16:
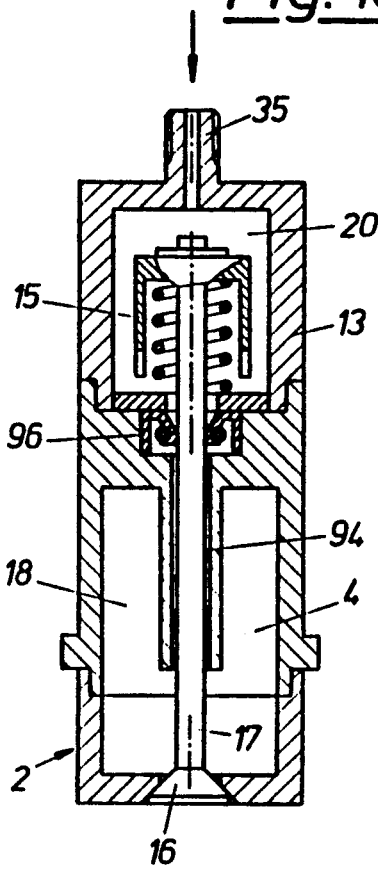
FIG. 16 shows a variant of the injection valve of FIG. 15.
Figure 17:
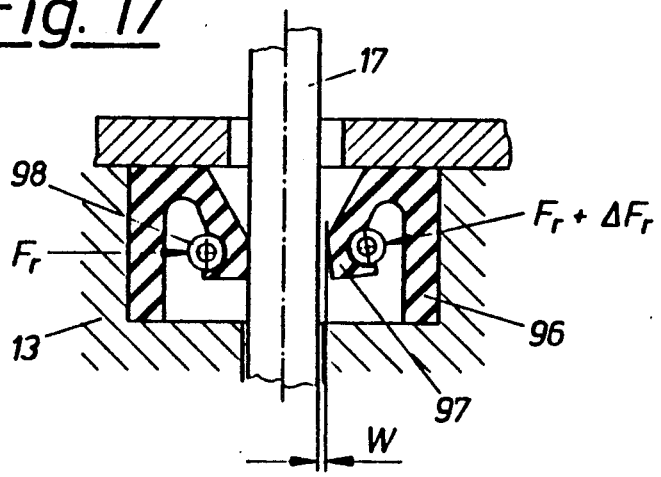
FIG. 17 shows a detail from FIG. 16.

For another design of the valve stem seal the variant of the injection system according to FIGS. 1 to 6 with "sequence control" are referred to. By exerting pressure on the back chamber 20 and thus the effective cross-section of the valve needle, the valve element 16 opens to its stop. This is followed by a further pressure rise above the opening pressure of the check valve 32, and fuel is injected into the gas storage cell. The check valve 32 may be replaced by a seal 96 shown in FIG. 16, which seals against a high-pressure from bottom to top, and against a considerably lower pressure from top to bottom. When the fuel pressure required for opening the valve is exceeded after the valve has opened fully, the radial sealing force $F_r$ adjusted by an O-spring 98 is exceeded at the sealing lip 97, and an inflow of fuel occurs. This will raise the sealing force to $F_r+\Delta F_r$, such that an equilibrium is obtained at the radial gap width W. The gap width W is in the range of several thousand parts to a few hundred parts of a millimeter, which means that the seal 96 can withstand a large number of load cycles without wear. Upon the completion of fuel injection and a pressure drop in the back chamber 20 the sealing lip 97 closes again, preventing a backflow of gases.

We claim:

1. A device for feeding fuel into a combustion chamber of a cylinder of an internal combustion engine, comprising:

a pump for fuel delivery, wherein an injection valve is provided as a withdrawal and injection unit comprising a valve element opening into said combustion chamber of said internal combustion engine;

a front chamber immediately adjacent to said valve element;

a back chamber spaced from said valve element, said valve element being used for regulating gas exchange between said combustion chamber and said front chamber, said front chamber serving as a storage cell for gases to be withdrawn from said combustion chamber, and wherein said valve element is actuated by an actuating element partly bordering said back chamber, said front chamber being connected to said back chamber via a check valve; and means for supplying fuel from said pump to said front chamber, wherein said means for supplying fuel connects said pump to said back chamber for operating the actuating element in response to fuel pump pressure.

2. A device according to claim 1, wherein a reciprocating pump is provided which is connected to said back chamber by means of a pressure line and wherein a pump chamber of said reciprocating pump is connected with a fuel tank of said combustion engine via a solenoid valve, and wherein a second solenoid valve is provided which is located in an additional fuel line connecting said fuel tank and said pressure line.

3. A device according to claim 2, wherein a check valve is positioned in said additional fuel line, through which excess fuel is returned into said fuel tank.

4. A device according to claim 1, wherein a reciprocating pump is provided which is connected to said back chamber by means of a pressure line and wherein a pump chamber of said reciprocating pump is connected with a fuel tank of said combustion engine via a solenoid valve, and wherein said solenoid valve is subjected to at least two different current intensities by pulse-length-modulated OFF/ON switching of the voltage applied to the electromagnet of said solenoid valve, thereby obtaining at least two different pressure levels.

5. A device according to claim 1, wherein said connecting line leading into said front chamber of said injection valve opens into an annular gap concentric with the valve stem, from said annular gap fuel will flow into said gas storage cell in direction of said valve element.

6. A device according to claim 1, wherein said back chamber of said injection valve is connected with said front chamber by a through-going annular passage concentric with the valve stem, a seal surrounding said valve stem being located in an enlarged portion of said passage, containing a pre-stressing element as said check valve.

7. A device according to claim 1, wherein a spring is placed in a spring chamber of said injection valve separated from said front chamber by a partition wall having an opening for a valve stem.

8. A device according to claim 1, wherein said valve element of said injection valve is closed exclusively by the gas pressure in said combustion chamber of said internal combustion engine, acting upon the cross-section of said valve element.

9. A device according to claim 1, wherein a metering device with a metering chamber is located in said housing of said injection valve, a metering plunger of said metering device is coaxial with and in contact with said plunger of said injection valve and also serves as a chamber on the actuating side of said metering device, and wherein said metering chamber is connected with said back chamber via a reducing valve and with said front chamber via a check valve, and wherein said back chamber is connected with a fuel feed line from a pressure-generating unit.

10. A device according to claim 9, wherein said pressure-generating unit comprises a fixed displacement pump followed by an electronically actuated flow-control unit and a pressure relief valve located on an outlet end of said fixed displacement pump, a three-way solenoid valve being provided which connects said back chamber of said injection valve to said flow-control unit in one position and to a return line into a fuel tank in another position.

11. A device according to claim 10, wherein fixed throttles are arranged in a line between said flow-control unit and said three-way solenoid valve, and in said return lines to said fuel tank.

12. A device according to claim 10, wherein said series-connected flow-control unit is replaced by an electronically controlled pressure-control unit positioned parallel to said fixed displacement pump.

13. A device according to claim 9, wherein said back chamber of said injection valve is closed off adjacent to said valve element by a diaphragm located normal to said valve axis, said diaphragm being used for actuating said metering plunger as well as said valve element.

14. A device according to claim 13, wherein a chamber below said diaphragm is subjected to pressure via a separate pressure line from said fixed displacement pump.

* * * * *